US006973673B2

(12) United States Patent
Beuk

(10) Patent No.: US 6,973,673 B2
(45) Date of Patent: Dec. 13, 2005

(54) INTRUSIVE DEVICE-SUPPORTING APPAREL

(76) Inventor: Staci J. Beuk, 143 Black Brook Rd., Hampton, NJ (US) 08827

( * ) Notice: Subject to any disclaimer, the term of this patent is extended or adjusted under 35 U.S.C. 154(b) by 4 days.

(21) Appl. No.: 10/716,784

(22) Filed: Nov. 19, 2003

(65) Prior Publication Data

US 2005/0102731 A1 May 19, 2005

(51) Int. Cl.[7] ..... A41D 13/00
(52) U.S. Cl. ..... 2/114; 2/69
(58) Field of Search ..... 2/114, 113, 115, 2/106, 105, 108, 69, 79, 227, 228, 238, 400, 2/102, 80, 83, 78.1–78.4; 604/174, 179, 345; 128/DIG. 26

(56) References Cited

U.S. PATENT DOCUMENTS 4,087,864 A * 5/1978 LaBove et al. ..... 2/102
4,422,186 A 12/1983 Loney
4,533,355 A * 8/1985 Fair ..... 604/345
4,570,268 A 2/1986 Freeman
4,578,062 A * 3/1986 Schneider ..... 604/174
4,582,508 A 4/1986 Pavelka
4,688,270 A * 8/1987 Denicola et al. ..... 2/102
5,403,285 A 4/1995 Roberts
5,806,096 A * 9/1998 Pennington ..... 2/80
6,032,289 A * 3/2000 Villapiano ..... 2/102
6,055,668 A 5/2000 Gros et al.
6,206,854 B1 * 3/2001 Weaver ..... 604/174
6,460,187 B1 * 10/2002 Siegel ..... 2/114
6,574,800 B1 * 6/2003 Leger et al. ..... 2/114
6,647,552 B1 * 11/2003 Hogan ..... 2/114

* cited by examiner

*Primary Examiner*—Gloria M. Hale
(74) *Attorney, Agent, or Firm*—Kenneth P. Glynn

(57) ABSTRACT

The present invention relates to intrusive device-supporting apparel for covering at least a portion of an upper body of a wearer, which includes a garment adapted to cover a portion of an upper body area, of a wearer, which has a front and a back. There are at least four orifices; one orifice being a neck orifice; two orifices being arm orifices, and one orifice being a bottom orifice. The garment has an inside and an outside, and is made of a washable fabric. At least one strip of fabric is either permanently attached or attachable to a material. The strip of fabric also has an inside and an outside. The strip of fabric is attached so as to render at least a portion of the strip of fabric inside and the strip of fabric outside, accessible to a wearer. There is garment attachment mechanism, which is connected to the strip of fabric. An intrusive device connector is connected to the garment attachment means and is adapted to receive and hold at least one tube for an intrusive device. The strip of fabric and the garment attachment means may be located within an area on the garment. The garment attachment means may be permanently attached or removeably attached to the strip of fabric. The garment attachment means may further include a member for attachment of the intrusive device connector.

18 Claims, 6 Drawing Sheets

INTRUSIVE DEVICE-SUPPORTING APPAREL

BACKGROUND OF THE INVENTION

1. Field of the Invention

The present invention relates to apparel which has means for supporting intrusive devices. More particularly, it relates to apparel which has a garment attachment means connected to a strip of fabric on the apparel garment and an intrusive device connector connected to the garment attachment means.

2. Information Disclosure Statement

The following is representative of hospital garments that hold intrusive devices:

U.S. Pat. No. 4,422,186 relates to a hospital garment which comprises finished slits with fasteners extending the entire length from the collar down the entire length of the sleeve to the wrist portion of the gown. This structure allows the placement and removal of intravenous apparatus as well as surgery applying or changing bandages without the necessity of removing the gown or cutting it apart. A similar garment is provided for the lower portion of a patient's body.

U.S. Pat. No. 4,570,268 to Freeman describes and illustrates a patient's garment which is suitable for various medical procedures, which will give the patient a sense of dignity and well-being. The patient's garment has a body portion and sleeves. The body portion includes a main panel, which can be positioned to either the front or rear side of the patient and a pair of adjacent side panels, which would normally be positioned on the other side of the patient. The outer side edges of the side panels are joined together in overlapping relationship when the garment is worn by the patient by a plurality of vertical spaced apart fasteners. The sleeves are sewn to the body portion, and the top of each sleeve is provided with an openable seam having adjacent mating edges which extend from the neck of the patient over the patient's shoulder and down along the arms. The mating edges can be held together in overlapping relationship by a plurality of spaced apart hook and loop fasteners. The fasteners can be opened to facilitate various hospital procedures such as X-rays, thorax and upper abdomen examinations, and I.V. therapy.

U.S. Pat. No. 4,578,062 to Schneider describes and illustrates a re-usable intravenous catheter holder, which is in the shape of a cut-off tank body garment that is fitted securely around the patient's chest by an elastic band around the base of the garment. The holder supports a catheter tube and coupling which protrudes form the patient's chest. The design also provides a means whereby the shoulder strap of the garment may be opened to allow access to the catheter without removal of the holder, while maintaining constant shape of the holder. Also, the holder may be worn or removed by the patient without experiencing discomfort.

U.S. Pat. No. 4,582,508 to Pavelka discloses a garment for holding, supporting, and receiving certain indwelling catheters, e.g. a Hickman catheter or similar device to a patient's body. The garment is generally comprised of three elements including strips to hold the garment securely to patient's body and a pocket element within which to store the catheter. Fastening means are provided to connect the elements, the means being of various types. The garment is made of various material including disposable or throwaway material.

U.S. Pat. No. 5,403,285 to Roberts discloses an apparatus for holding a catheter of a type having a flexible tube which can have one end thereof which extends into a large vein near a heart. The tube has a closure cap on the other end thereof for allowing the introduction of medication or fluids into the blood in the tube so that they can be quickly mixed with blood for permitting blood to be quickly with drawn therefrom. An elongated, flexible, elastic member is adapted to extend completely around the chest of a person and over the flexible tube at the location where the tube exits the body. Hook and loop closure members are provided on the flexible members for holding the tube in a coiled position adjacent the flexible member. The flap is provided with hook and loop fasteners for selectively covering up the coiled tube when not is use, but allowing easy access to the tube for adding medications, drawing blood, or to change the entire securing apparatus from time to time so that it can be washed, cleaned and re-used. Also, elastic has hook and loop fasteners on the ends thereof so that it can be easily stretched and fastened around the chest.

U.S. Pat. No. 6,032,289 to Villapiano describes and illustrates security garments that are provided for retaining catheters and other types of tubing in place. The security garments are in the form of undershirts, brassieres, vests, or sleeves, and include fastening means to retain the catheters and tubing in place without vertical or horizontal movement.

U.S. Pat. No. 6,055,668 to Gross et al. relates to a post-surgical garment for use following breast or chest surgery wherein the garment has straps having a length of hook and loop material attached at overlapping ends whereby an individual user drapes the garment over the shoulders and extends the back straps down the front where the ends of the mating shoulder stapes are secured with hook and loop material at a comfortable user selectable length which may be about half way between the top of the patient's shoulder and the patient's breasts. The main body of the garment is open in the center and also having, overlapping ends having a length of hook and loop material attached thereon, is secured at the front. Another length of hook and loop material is located along the hem of the garment which acts as means for attaching a number of attachable and detachable bags provided as mean for holding the collection devices, bags or e.g., a chemotherapy pump, depending on the therapy, or are themselves collections bags and each bag having a strap permanently attached thereon to the external surface of the bag and having a length of hook and loop material located on each end of the strap whereby each strap can retain a number of tubes passing between the bag and the point of surgery on the patient's body. Also located on the inner/rear of the garment within the cup area of the garment is a pocket for inserting and retaining a prosthesis when applicable.

U.S. Pat. No. 6,460,187 to Siegel describes and illustrates multipurpose medical clothing, such as a gown or robe, that safely accommodates medical appliances attached to a patient, which affords privacy, and thus encourages the patient to be up and ambulatory. The illustrated gown embodiment includes rectangular front and back panels open at the sides, belting, inside and outside pockets, and inside and outside hangers. The panels are of equal width greater than average human shoulder width to provide sleeves when worn. The belting extends from the back panel around the sides lower and is tied in front. The front panel is slightly shorter than the back so that the panels are of about the same height when the gown is worn and belted. The pockets are attached to the inside and outside of the front pane below the belt line at substantially the same height and in transversely spaced relation to each other. The hangers are attached to the inside and outside, respectively, below the inside and outside pockets. The gown accommodates various medical appliances such as: a telemetry transmitter with its sensors attached to a patient and its leads passing under the tied belting to relieve the pressure on the sensors; a catheter unit hung form either the inside or outside hangers, and thus below the patient's bladder, with its tubing coiled and supported on the hangers; and IV tubing threaded through one of the oops formed by hangers and thus supported between an adjacent mobile stand and the patient.

Notwithstanding the prior art, the present invention is neither taught nor rendered obvious thereby.

SUMMARY OF THE INVENTION

The present invention relates to intrusive device-supporting apparel for covering at least a portion of an upper body of a wearer. One embodiment, includes a garment adapted to cover a portion of an upper body area, of a wearer, which has a front and a back. There are at least four orifices; one orifice being a neck orifice; two orifices being arm orifices, and one orifice being a bottom orifice.

The garment has an inside and an outside, and is made of a washable fabric. At least one strip of fabric is attached to the inside of the garment, in which the strip of fabric also has an inside and an outside. The strip of fabric is attached to the inside of the garment so as to render at least a portion of the strip of fabric inside and the strip of fabric outside, accessible to a wearer. In preferred embodiments, the strip of fabric is permanently attached to the inside of the garment.

There is garment attachment means, which is connected to the strip of fabric. An intrusive device connector is connected to the garment attachment means and is adapted to receive and hold at least one tube for an intrusive device.

The strip of fabric and the garment attachment means may be located within an area on the garment. Most preferably, the placement is closest to the body part that the intrusive device is inserted and/or probed. Thus, the strip of fabric and the garment attachment means may be located in an upper area of the garment and/or in a shoulder area. Moreover, the placement of the strip of fabric is not critical to the invention. Thus, the strip of fabric may be positioned anywhere on the garment. Most preferable, the strip of fabric is placed near the body part where the intrusive device is to be inserted and/or probed.

The garment attachment means may be permanently attached or removeably attached to the strip of fabric. The garment attachment means may be selected from the group consisting of a snap fastener, a hook and loop fastener, a swivel fastener, a pin fastener, a hook and eye fastener, a button fastener and the like. Moreover, the garment attachment means may be a flexible material with an attachment component selected from the group consisting of thread, glue, heat weld material and the like. Furthermore, the garment attachment means may be selected from the group consisting of a clamp, a clip, a grommet, a buckle, a pin and a tape. The garment attachment means may further include a material strip for attachment and/or connection of the intrusive device connector. The material strip may be made from cloth, elastic, sponge, plastic, string, tape, and the like.

The intrusive device connector may be selected from the group consisting of a hook and loop fastener, a clip, a clamp, an elastic, a plastic, a hook and eye fastener, a string, a snap, a pin, a tape and the like.

In another embodiment an intrusive device-supporting apparel covers at least a portion of an upper body and at least a portion of a lower body, of a wearer. The apparel includes a garment adapted to cover a portion of an upper body area and a portion of a lower body, of a wearer, in which the garment includes at least an upper piece and at least a lower piece. The upper piece has a front and a back, and at least four upper piece orifices. One of the upper piece orifices is a neck orifice; two of the upper piece orifices are arm orifices; and one of the upper piece orifices is an upper piece bottom orifice. The lower piece has a front and a back, and at least three lower piece orifices. One of the lower piece orifices is a waist orifice; and two of the lower piece orifices are leg orifices. The upper piece and the lower piece each have an inside and an outside.

The garment is made of a washable fabric and has at least one strip of fabric attached to at least one of the inside of the upper piece and the inside of the lower piece. The strip of fabric has an inside and an outside, and is attached to at least one of the inside of the upper piece and the inside of the lower piece so as to render at least a portion of the inside of the strip of fabric and the outside of the strip of fabric, accessible to a wearer. In addition, the apparel includes garment attachment means and intrusive device connector, as described herein above.

In another embodiment, an intrusive device-supporting system is attachable to a material, the system including a strip of fabric, which has an inside and an outside. When the strip of fabric is attached to the material, at least a portion of the inside and the outside of the strip of fabric is accessible to a user. A material attachment means for attaching the strip of fabric to the material is connected to the strip of fabric. An intrusive device connector is connected to one of the material attachment means and the strip of fabric and is adapted to receive and hold at least one tube for an intrusive device. The material attachment means is selected from the group consisting of heat based iron-on attachment material, glue, adhesive, hook and loop fasteners, stitching, pins, buttons, snaps and the like.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
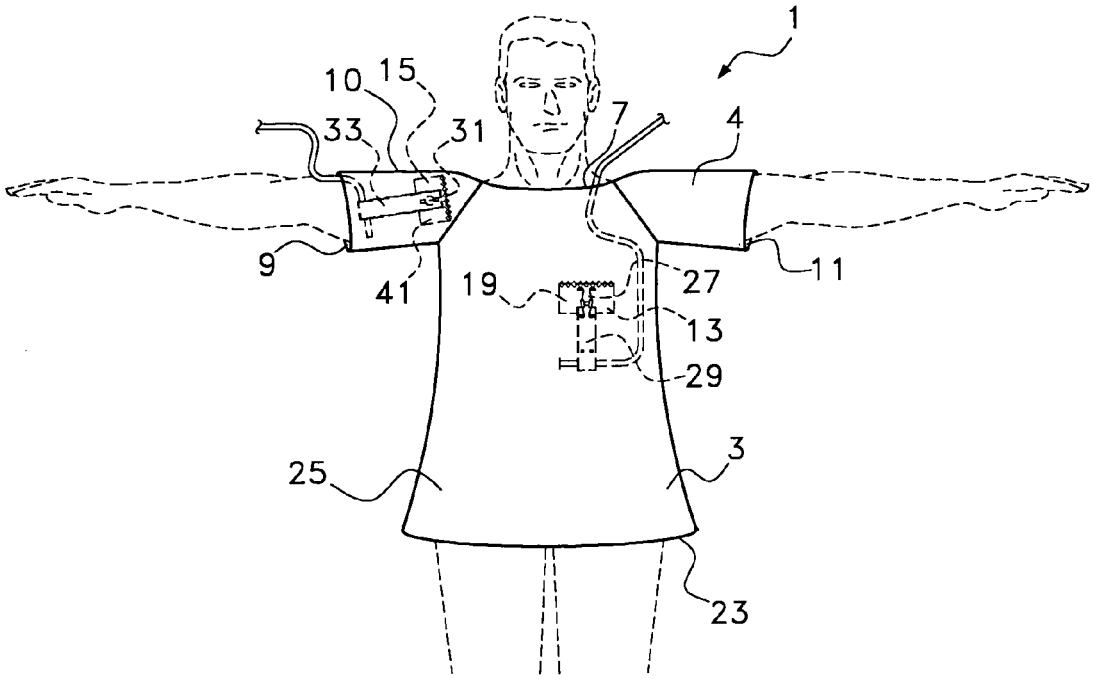
FIG. 1 and FIG. 2 show a front view and a rear view of a present invention intrusive device-supporting apparel, respectively wherein there are a plurality of strips of fabric with garment attachment means and intrusive device connectors, as well as a garment that covers a portion of an upper body.

The present invention relates to apparel which has means for supporting intrusive devices. More particularly, it relates to apparel which has a garment attachment means connected to a strip of fabric on the apparel garment and an intrusive device connector connected to the garment attachment means.

The intrusive-device-supporting apparel includes at least one strip of fabric for attachment with a garment attachment means and an intrusive device connector. The strip(s) of fabric are located in various parts of the apparel near body parts that may require insertion and/or probe of an intrusive device. Such intrusive devices include, but are not limited to, intravenous lines, catheters, telemetry transmitters, probes in laser surgery, heart probes, feeding tubes, body part drainage tubes, chemotherapy distribution tubes, collection bags, and the like. Rather than have a series of tape on multiple parts of the body to secure the devices, the present invention secures the devices near the point of entry into a body part. Thus, the intrusive devices are near the body part for quick and precise use of the devices.

The apparel may include a single-piece garment that covers at least a portion of the upper body, or an at least a two-piece garment that covers at least a portion of the upper body and at least a portion of the lower body. Thus, the apparel may be a long or short gown, a pajama-like garment, or a robe. Length and area covered are general, and it is within the scope of the invention to include variously designed garment styles.

The garment attachment means may be an integral part of the intrusive device connector or a separate element. The garment attachment means may be stitching, gluing, heat welding, clip, clamp, button, VELCRO® hook and loop fasteners, hook and eye, snap, swivel snap, hook, safety pin, staple, grommet, buckles, slide block buckle, snap hook, cord with stop, expander button, snap tape or any other available fastener, or combinations(s) thereof. Thus, the garment attachment means may be permanently attached to the garment, permanently attached to the connector, permanently attached to both the garment and the connector, removeably attachable to either the garment or the connector, or removeably attachable to both the garment and the connector.

The garment attachment means may further include a member for connection of the intrusive device connector. The member may be made from cloth, elastic, sponge, plastic, string, tape and the like.

The intrusive device connector is sized and shaped to hold at least one tube for an intrusive device. The intrusive device connector may be a hook and loop fastener, a clip, a clamp, elastic, a hook and eye fastener, a string, a tape, a snap, a pin and the like.

In another embodiment, an intrusive device-supporting system is attachable to a material, which includes a strip of fabric, which has an inside and an outside. When the strip of fabric is attached to the material, at least a portion of the inside and the outside of the strip of fabric is accessible to a user. A material attachment means for attaching the strip of fabric to the material is connected to the strip of fabric. An intrusive device connector is connected to one of the material attachment means and the strip of fabric and is adapted to receive and hold at least one tube for an intrusive device. The material attachment means is selected from the group consisting of heat based iron-on attachment material, glue, adhesive, hook and loop fasteners, pins and the like.

Figure 2:
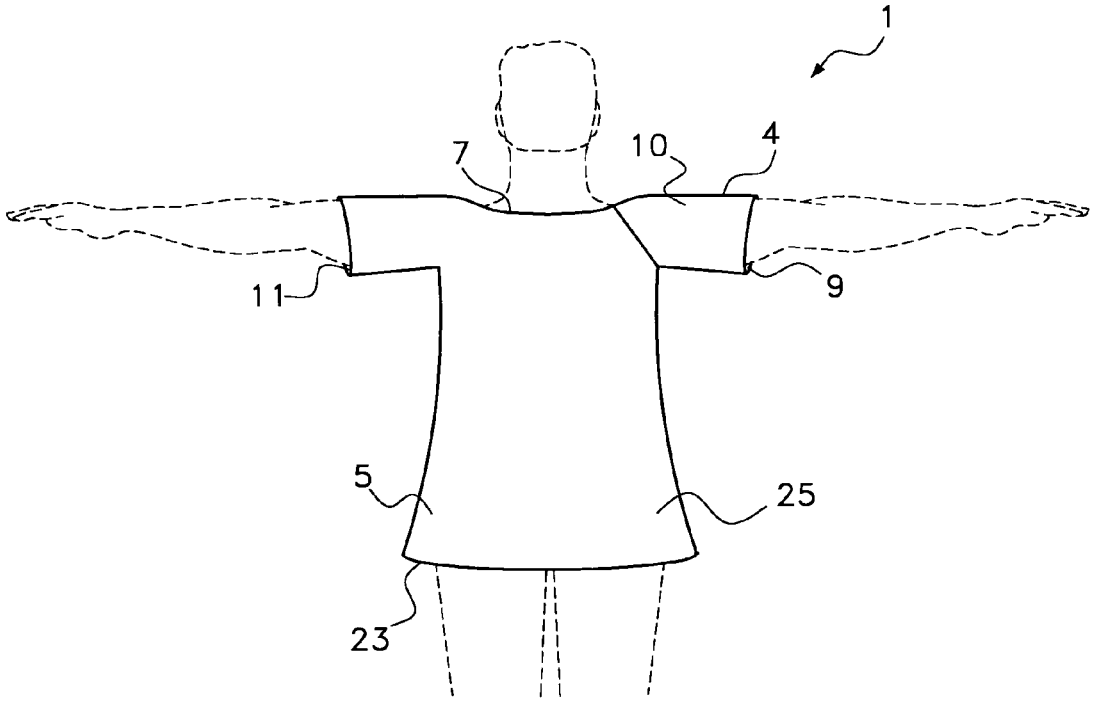
Figure 3:
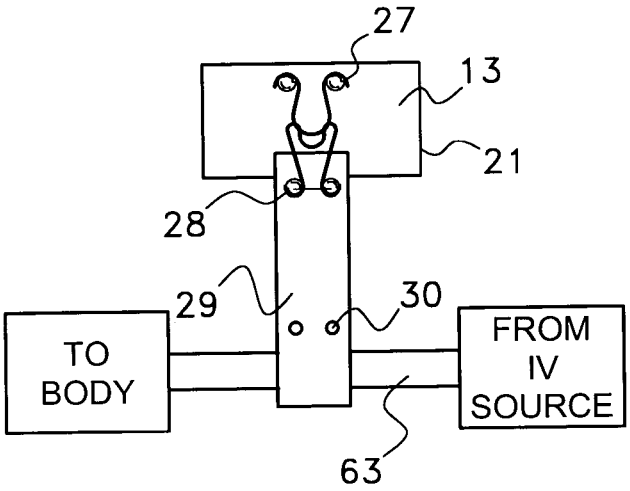
FIG. 3 and FIG. 4 show an exploded front view and a side view, respectively, of a present invention, strip of fabric with garment attachment means and intrusive device connector shown in FIG. 1 and FIG. 2.
Figure 4:
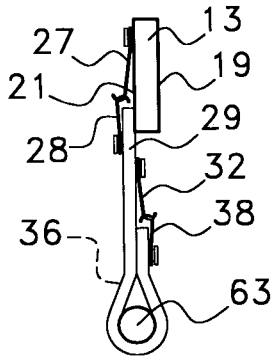
Figure 5:
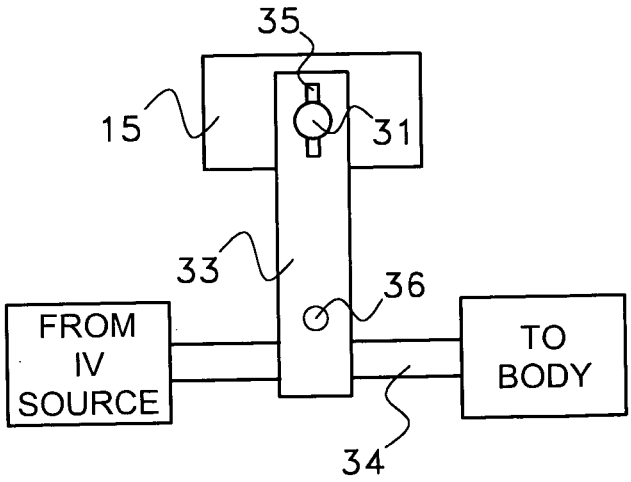
FIG. 5 and FIG. 6 show an exploded front view and a side view, respectively of another embodiment of a present invention, strip of fabric with garment attachment means and intrusive device connector shown in FIG. 1 and FIG. 2.
Figure 6:
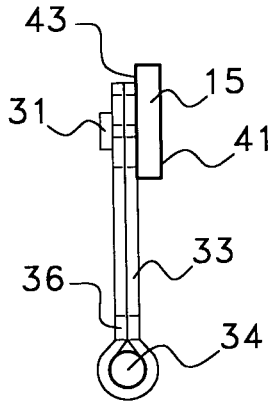

Referring now to the drawings, FIG. 1 and FIG. 2, show a front view and a rear view of a present invention intrusive device-supporting system 1, respectively wherein there are a plurality of strips of fabric 13 and 15 with garment attachment means 27 and 31, respectively and intrusive device connectors 29 and 33, respectively. In addition, there is a garment 4 that covers a portion of an upper body. FIG. 3 and FIG. 4 show an exploded view and side view of the present invention strip of fabric 13 with the garment attachment means 27 and the intrusive device connector 29 shown in FIG. 1 and FIG. 2. FIG. 5 and FIG. 6 show an exploded view and a side view, respectively of another embodiment of the present invention strip of fabric 15 with the garment attachment means 31 and the intrusive device connector 33, shown in FIG. 1 and FIG. 2.

The intrusive device-supporting system 1 includes the garment 4 adapted to cover a portion of an upper body area of a wearer, which has a front 3 and a back 5. There are at least four orifices; one orifice being a neck orifice 7; two orifices being arm orifices 9; and one orifice being a bottom orifice 23. The garment 4 also includes a shoulder area.

The garment 4 has an inside 11 and an outside 25, and is made of a washable fabric. At least one strip of fabric 13, 15 is permanently attached to the inside 11 of the garment 4, in which the strip of fabric 13 has an inside 19 and an outside 21, and the strip of fabric 15 has an inside 41 and an outside 43. The strip of fabric 13 is attached to the inside 11 of the garment 4 so as to render at least a portion of the strip of fabric 13 inside 19 and outside 21 accessible to a wearer. The strip of fabric 15 is attached to the inside 11 of the garment 4 so as to render at least a portion of the strip of fabric 15 inside 41 and outside 43 accessible to a wearer. There is garment attachment means 27 which is connected to the strip of fabric 13. Intrusive device connector 29 is connected to the garment attachment means 27 and is adapted to receive and hold at least one tube for an intrusive device. There is another garment attachment means 31 which is connected to the strip of fabric 15. Intrusive device connector 33 is connected to the garment attachment means 31 and is adapted to receive and hold at least one tube for an intrusive device.

Referring now specifically to FIG. 3 and FIG. 4, the garment attachment means 27 is an eye which connects to a mating hook 28 located on an intrusive device connector 29. By hooking the mating hook 28 with the garment attachment means 27, the intrusive device connector 29 becomes removably attached to the strip of fabric 13. In this case, garment attachment means, eye 27, is permanently attached to the strip of fabric 13. In addition, the intrusive device connector includes an eye 32 and mating hook 38 located on the opposite end of the intrusive device connector 29 from the garment attachment means 27 and mating hook 28. The operation of the eye 32 and mating hook 38 provides for a support to hold an intrusive device 63 in place. The eye 32 is attached to the intrusive device connector through stitching 30.

Referring now specifically to FIG. 5 and FIG. 6, the garment attachment means 31 is a button on the strip of fabric 15. An intrusive device connector 33, which may be made from an elastic or gripping skid-resistant material, is wrapped around an intrusive device tube 34 and is adapted to hold the intrusive device tube 34 in place. The intrusive device connector 33 includes apertures on both ends 35 for connection to the button 31. Moreover, there is an intrusive device connector attachment means, in this case, snap 36 that, when snapped together forms a secure near tubular shape around a portion of the intrusive device connector 33 so that the intrusive device tube 34 may be held securely in place. The intrusive device connector attachment means 36 may be a mechanism that allows for connection of two portions of the intrusive device connector to form a near circular portion.

The strip of fabric 13, 15 and the garment attachment means 27, 31, respectively, may be located within any area on the garment 1. Most preferably, the placement is closest to the body part that the intrusive device is inserted and/or probing. Thus, the strip of fabric 13, 15 and the garment attachment means 27, 31 respectively, may be located in an upper area of the garment and/or in a shoulder area, as shown by FIG. 1 and FIG. 2.

Figure 8:
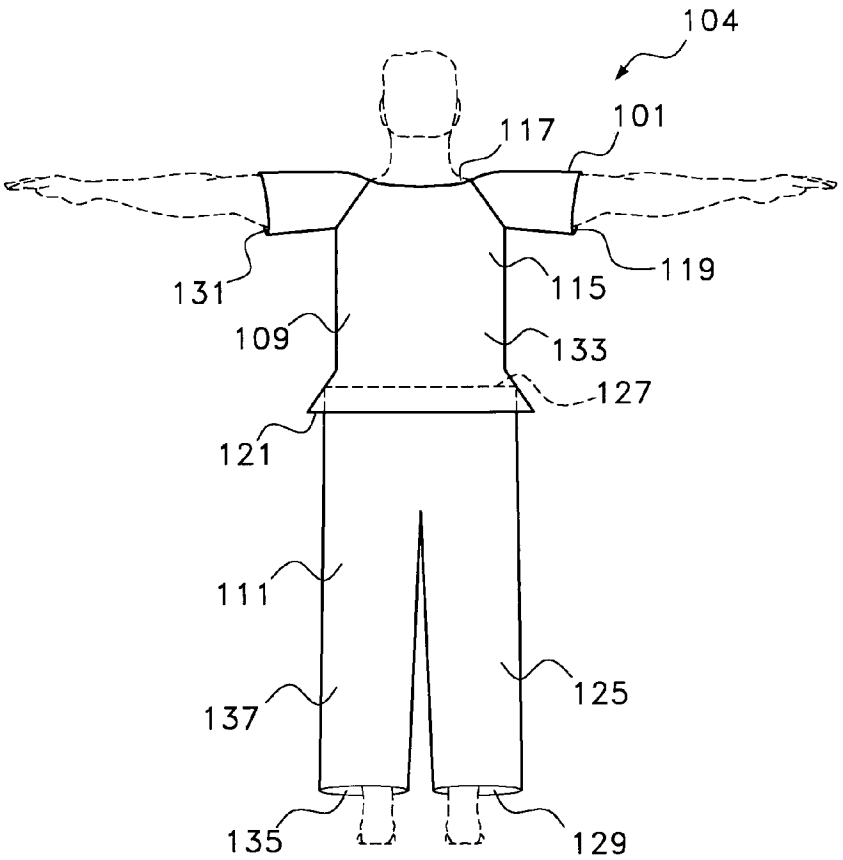
FIG. 7 and FIG. 8 show a front view and a rear view of a present invention intrusive device-supporting apparel, respectively, wherein there is at least one strip of fabric with garment attachment means and intrusive device connector, as well as a garment that has at least two pieces covering a portion of an upper body and a portion of a lower body.
Figure 7:
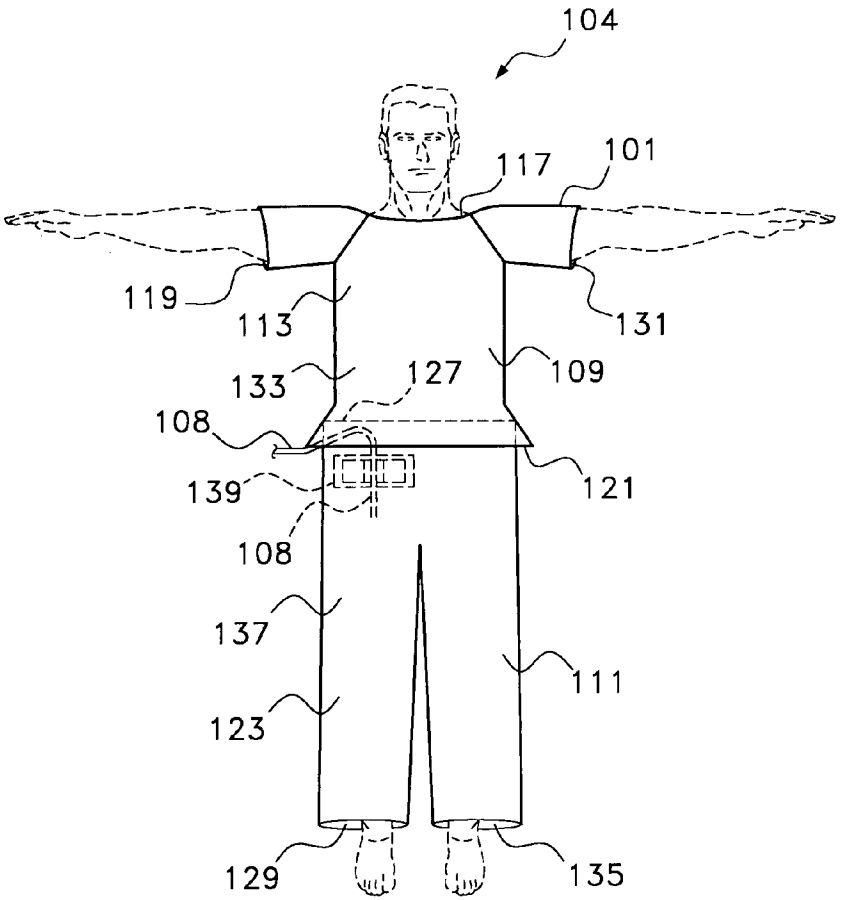
Figure 9:
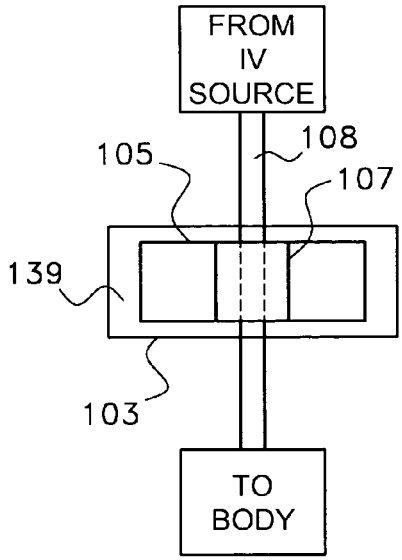
FIG. 9 shows an exploded front view of a present invention garment attachment means and intrusive device connector shown in FIG. 7.

Referring now to FIG. 7, FIG. 8 and FIG. 9, there is shown a present invention intrusive device-supporting system 104 wherein there is at least one strip of fabric 103 with garment attachment means 105 and intrusive device connector 107, as well as a garment 101 that has at least two pieces 109, 111 covering at least a portion of an upper body and at least a portion of a lower body, of a wearer. FIG. 9 shows an exploded view of a present invention garment attachment means 105 and intrusive device connector 107 shown in FIG. 7 and FIG. 8.

The upper piece 109 of the garment 101 has a front 113 and a back 115, and at least four upper piece orifices. One of the upper piece orifices is a neck orifice 117; two of the upper piece orifices are arm orifices 119; and one of the upper piece orifices is an upper piece bottom orifice 121. The lower piece 111 of the garment has a front 123 and a back 125, and at least three lower piece orifices. One of the lower piece orifices is a waist orifice 127; and two of the lower piece orifices are leg orifices 129. The upper piece 109 and the lower piece 111 each have an inside 131 and 135, respectively, as well as an outside 133 and 137, respectively.

The garment 101 is made of a washable fabric and has at least one strip of fabric 103 permanently attached to at least one of the inside of the upper piece 131 and the inside of the lower piece 135. The strip of fabric 103 has an inside 139 and an outside, and is attached to at least one of the inside 131 of the upper piece 109 and the inside 135 of the lower piece 111 so as to render at least a portion of the inside 139 of the strip of fabric 103 and the outside of the strip of fabric 103, accessible to a wearer. In addition, the apparel 101 includes the garment attachment means 105 and intrusive device connector 107. In this case, the garment attachment means 105 is permanently attached to the strip of fabric 103 through heat welding, gluing, sewing, and the like. The intrusive device connector 107 is VELCRO® hoop and loop fasteners, which are attached to the garment attachment means 105 and hold an intrusive device tube 108 in place.

Figure 10:
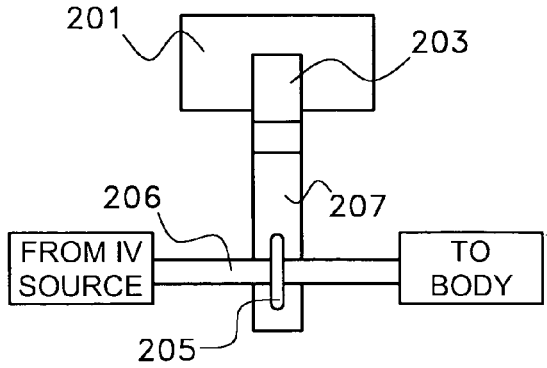
FIG. 10 shows a front view of a present invention clamp garment attachment means and a clamp intrusive device connector.

Referring now to FIG. 10, there is shown a present invention clamp garment attachment means 203 having a member 207 wherein a clamp intrusive device connector 205 is attached. The clamp or clip 203 garment attachment means clips a member 207 onto a strip of fabric 201, which when in use with the present invention is attached to a garment. The intrusive device connector, in this case, the clamp 205 holds a tube for an intrusive device 206 in place.

Figure 11:
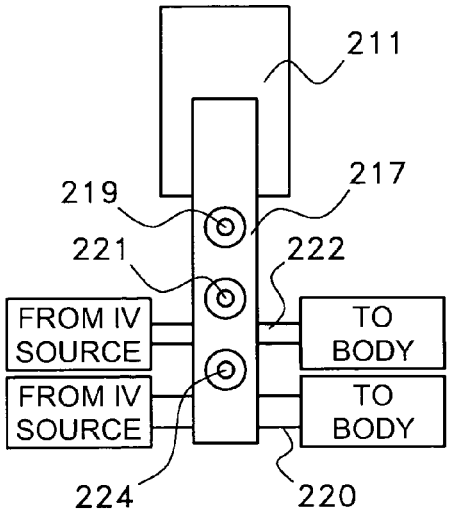
FIG. 11 shows a front view of a present invention plurality of snap garment attachment means forming a plurality of intrusive device connectors.

Referring now to FIG. 11, there is shown another embodiment of a present invention garment attachment means is heat welding in which an intrusive device connector 217 is heat welded to a strip of fabric 211. The intrusive device connector 217 includes a plurality of snaps 219, 221, and 224 having mating snap parts (not shown). When snapped, the plurality of snaps 219, 221, and 224 provide for different arcs on loops of the intrusive device connector 217 so that various sized and placed intrusive device tubes 220 and 222 may remain in place. Thus, when snaps 219, 221, and 224 mate with corresponding snaps on the intrusive device connector 217, intrusive tubes 220 and 222 may remain securely in place.

Figure 12:
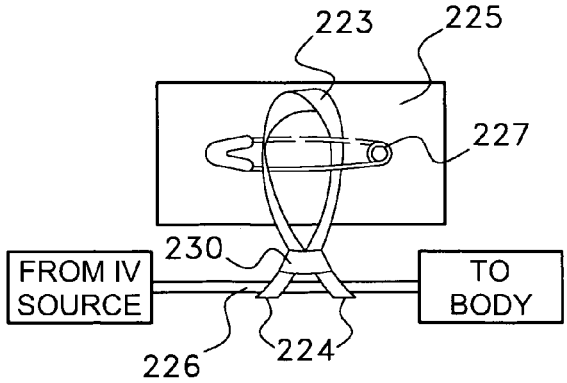
FIG. 12 and FIG. 13 shows a front view and a side view, respectively of a present invention pin garment attachment means and an elastic band intrusive device connector.
Figure 13:
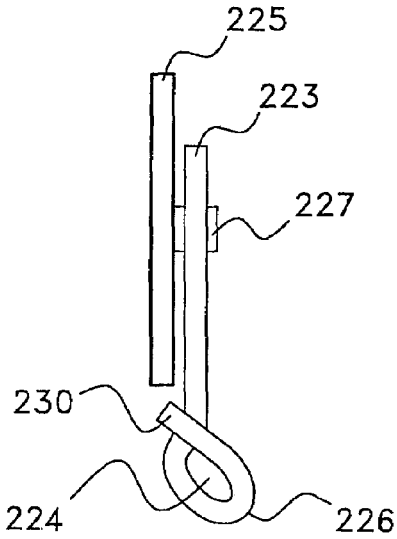

Referring now to FIG. 12 and FIG. 13, there is shown another embodiment of a present invention garment attachment means 227 and an intrusive device connector 223. The garment attachment means, in this case, safety pin 227 is attached to a strip of fabric 225. The intrusive device connector, in this case, elastic band 223, which is secured with safety pin 227 and when knotted forms an aperture 224 through which an intrusive device tube 226 may be positioned and supported. The elastic 223 band is tied so that there is an aperture 224 and a knot 230.

Figure 14:
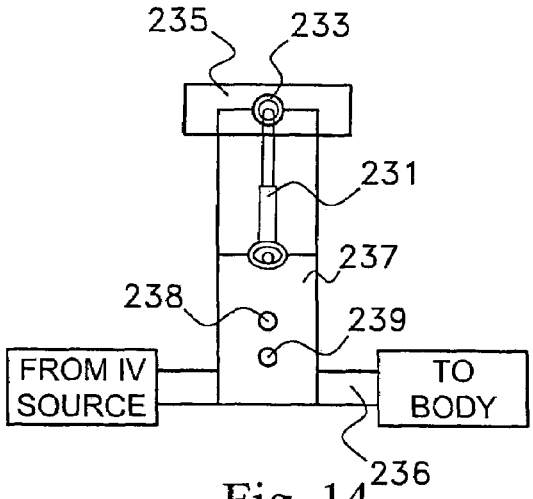
FIG. 14 shows a front view of a present invention swivel hook and grommet garment attachment means.

Referring now to FIG. 14, there is shown another embodiment of a present invention garment attachment means having a swivel hook 23 land mating grommet 233. A strip of fabric 235, which is attachable to a garment (not shown), is connected to the garment attachment means 231 through the grommet 233. An intrusive device connector 237 for connecting an intrusive device tube is attached to the strip of fabric 235, so that one end of the intrusive device connector 237 is attached to the strip of fabric 235 while the other end of the intrusive device connector 237 includes the swivel hook 231. The intrusive device connector 237 is made from a gripping, skid-resistant material or a sticky material, which holds the intrusive device tube 236 in place. In addition, there are a plurality of snaps 238 and 239 that provide for a more secure holding of the intrusive device tube 236. Thus, in operation, when the swivel hook 231 is connected to the grommet 233 the member forms a loop on an end opposite the swivel hook 231, in which the loop allows an intrusive device tube 236 to be secured in place because of the gripping action of the material of the intrusive device connector 236, as well as the fit formed by the plurality of snaps 238, 239.

Figure 15:
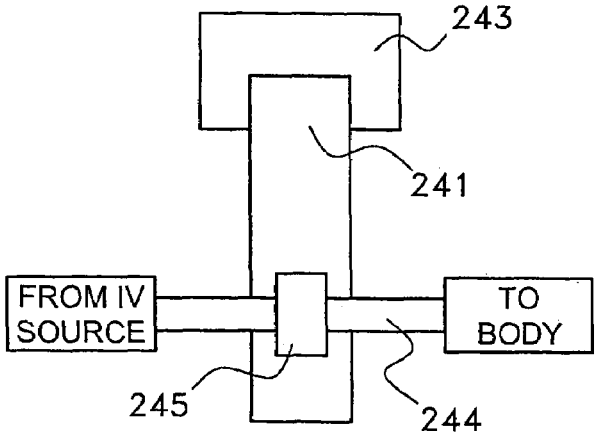
FIG. 15 shows a front view of a present invention garment attachment means that is heat welded to a strip of fabric, and a VELCRO® hook and fastener intrusive device connector.

Referring now to FIG. 15, there is shown a present invention garment attachment means 241 that is heat welded to a strip of fabric 243. This is a permanent attachment and further, an intrusive device connector, in this case, a VELCRO® hook and fastener 245 is attached to the garment attachment means 241. The VELCRO® hook and fastener 245 permits an intrusive device tube 244 to remain in place.

Figure 16:
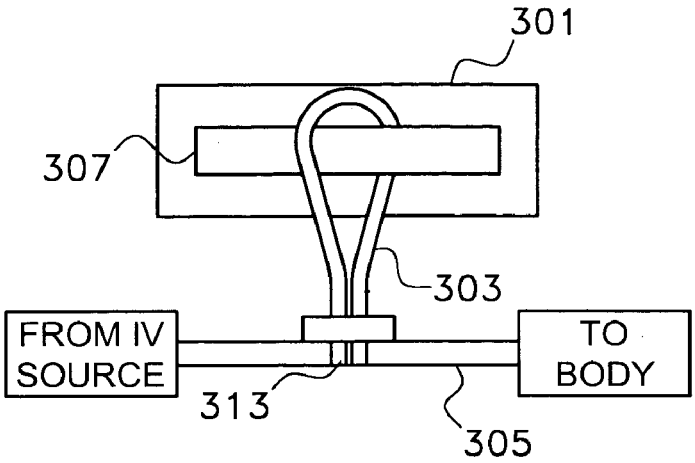
FIG. 16 and FIG. 17 show a front view and a side view, respectively, of a present invention strip of fabric with a flexible plastic member forming an intrusive device connector and a VELCRO® hook and fastener forming garment attachment means.
Figure 17:
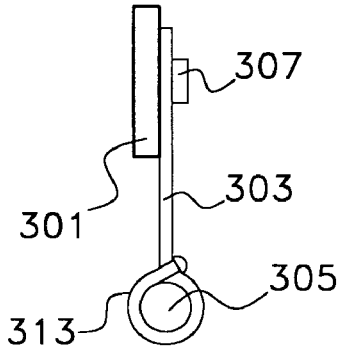

FIG. 16 and FIG. 17 show a front view and a side view, respectively; of a present invention strip of fabric 301 with garment attachment means 307, in this case, a VELCRO® hoop and loop fastener. The garment attachment means 307 attaches a flexible plastic member 303 to the strip of fabric 301. The flexible plastic member 303 is wrapped around an intrusive device tube 305 at an intrusive device connector portion 313. When the flexile plastic member 303 is wrapped around the intrusive device tube 305, the intrusive device connector portion will allow for any radius of the intrusive device tube 305. The flexible plastic member 303 is made from a spring plastic, which allows for an especially secure connection to the intrusive device tube 305.

All of the strips of fabric, the garment attachment means, and the intrusive device connectors, discussed in the figures herein above, may be part of a garment in which the strips of fabric are attached to the garment. In addition, the three components of fabric, garment attachment means and intrusive device connector may be made attachable to a garment through the strip of fabric being attachable to the garment through the garment attachment means. The garment attachment means may be heat based iron-on attachment material, glue, adhesive, VELCRO® hook and loop fastener, pin and the like.

Figure 18:
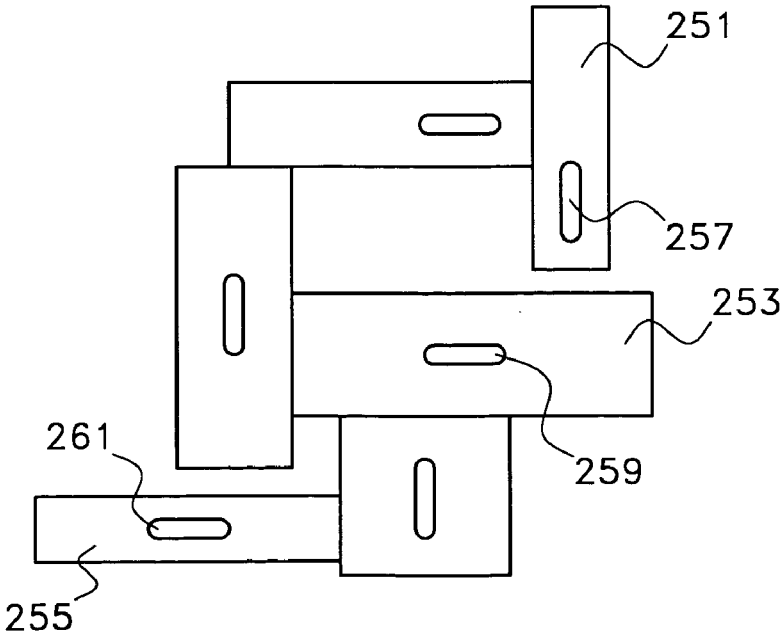
FIG. 18 shows an arrangement of a maze of strips of fabric that may be attached to an inside of a present invention garment.

Finally, FIG. 18 shows a maze of a plurality of strips of fabric 251, 253 and 255 that may be attached to an inside of a present invention garment near a body part which may be accessed by an intrusive device. The strips of fabric 251, 253, 255 each include an aperture 257, 259, 261, respectively for mating with a button on a garment attachment means. The plurality of strips of fabric provides for a selection of the best placement of an intrusive device, in relationship to the intruded body part. By "best placement" is meant that strip of fabric that permits the most proximate or closest access to the intruded body part while allowing for spaced needed for the intrusive device.

Obviously, numerous modifications and variations of the present invention are possible in light of the above teachings. It is therefore understood that within the scope of the appended claims, the invention may be practiced otherwise than as specifically described herein.

What is claimed is:

1. An intrusive device-supporting apparel for covering at least a portion of an upper body of a wearer, which comprises:

(a.) a garment adapted to cover a portion of an upper body area of a wearer having a front and a back and having at least four orifices, one of said orifices being a neck orifice, two of said orifices being arm orifices, and one of said orifices being a bottom orifice, said garment having an inside and an outside, said garment being made of a washable fabric, said garment having at least one strip of fabric attached to said inside of said garment so as to render at least a portion of said strip of fabric accessible to a wearer;

(b.) garment attachment means connected to said strip of fabric; and (c.) an intrusive device connector being connected to one of said garment attachment means and said strip of fabric and adapted to receive and hold at least one tube for an intrusive device, wherein said garment attachment means is selected form the group consisting of a clamp, a clip, a grommet, a buckle and a tape.

2. The apparel of claim 1 wherein said strip of fabric and said garment attachment means are located in an upper area of said garment.

3. The apparel of claim 1 wherein said garment includes shoulder areas, and said strip of fabric and said garment attachment means are located in said shoulder areas.

4. The apparel of claim 1 wherein said garment attachment means is permanently attached to said strip of fabric.

5. The apparel of claim 1 wherein said garment attachment means is removeably attached to said strip of fabric.

6. An intrusive device-supporting apparel for covering at least a portion of an upper body of a wearer, which comprises:

(a) a garment adapted to cover a portion of an upper body area of a wearer having a front and a back and having at least four orifices, one of said orifices being a neck orifice, two of said orifices being arm orifices, and one of said orifices being a bottom orifice, said garment having an inside and an outside, said garment being made of a washable fabric, said garment having at least one strip of fabric attached to said inside of said garment, said strip of fabric having an inside and an outside, said strip of fabric being attached to said inside of said garment so as to render at least a portion of said strip of fabric inside and said strip of fabric outside, accessible to a wearer;

(b) garment attachment means connected to said strip of fabric; and (c) an intrusive device connector being connected to one of said garment attachment means and said strip of fabric and adapted to receive and hold at least one tube for an intrusive device, wherein said garment attachment means is selected from the group consisting of a snap fastener, a hook and loop fastener, a swivel fastener, a pin fastener, a hook and eye fastener, and a button fastener.

7. The apparel of claim 6 wherein said garment includes shoulder areas, and said strip of fabric and said garment attachment means are located in said shoulder areas.

8. The apparel of claim 6 wherein said garment attachment means is permanently attached to said strip of fabric.

9. The apparel of claim 6 wherein said garment attachment means is removeably attached to said strip of fabric.

10. The apparel of claim 6 wherein said garment attachment means further includes a member for attachment of said intrusive device connector.

11. An intrusive device-supporting apparel for covering at least a portion of an upper body and at least a portion of a lower body, of a wearer, which comprises:

(a) a garment adapted to cover a portion of an upper body area and a portion of a lower body area, of a wearer, wherein said garment includes at least an upper piece and at least a lower piece, said upper piece having a front and a back and having at least four upper piece orifices, one of said upper piece orifices being a neck orifice, two of said upper piece orifices being arm orifices, and one of said upper piece orifices being a upper piece bottom orifice, said lower piece having a front and a back and having at least three lower piece orifices, one of said lower piece orifices being a waist orifice, and two of said lower piece orifices being leg orifices, said upper piece and said lower piece, each having an inside and an outside, said garment being made of a washable fabric, said garment having at least one strip of fabric attached to at least one of said inside of said upper piece and said inside of said lower piece, so as to render at least a portion of said strip of fabric accessible to a wearer;

(b) garment attachment means connected to the strip of fabric; and (c) an intrusive device connector being connected to one of said garment attachment means and said strip of fabric and adapted to receive and hold at least one tube for an intrusive device.

12. The apparel of claim 11 wherein said strip of fabric and said garment attachment means are located in at upper area of said lower piece of said garment.

13. The apparel of claim 11 wherein said garment attachment means is permanently attached to said strip of fabric.

14. The apparel of claim 11 wherein said garment attachment means is removable attached to said strip of fabric.

15. The apparel of claim 14 wherein said garment attachment means is selected from the group consisting of a snap fastener, a hook and loop fastener, a swivel fastener, a pin fastener, a hook and eye fastener, and a button fastener.

16. The apparel of claim 11 wherein said garment attachment means is a flexible material with an attachment component selected from the group consisting of thread, glue, and heat weld material.

17. The apparel of claim 11 wherein said intrusive device connector is selected from the group consisting of a hook and loop fastener, a clip, a clamp, an elastic, a hook and eye fastener, a string, a stringy plastic and a tape.

18. The apparel of claim 11 wherein said strips of fabric are formed in a maze on said garment so that one of said strips may be utilized for best placement of the intrusive device in relation to an intruded body part.

* * * * *